US006071080A

United States Patent [19]

Van Der Wilk et al.

[11] Patent Number: 6,071,080

[45] Date of Patent: Jun. 6, 2000

[54] VACUUM DEVICE HAVING A GETTER DEVICE

[75] Inventors: Ronald Van Der Wilk; Johannes J. M. Overbeek, both of Eindhoven, Netherlands

[73] Assignee: U.S. Philips Corporation, New York, N.Y.

[21] Appl. No.: 08/879,168

[22] Filed: Jun. 19, 1997

[30] Foreign Application Priority Data

Jun. 24, 1996 [EP] European Pat. Off. ..... 96201751

[51] Int. Cl.[7] ..... F04B 37/02

[52] U.S. Cl. ..... 417/48; 313/560; 313/481

[58] Field of Search ..... 417/48; 313/481, 313/477 R, 560, 553

[56] References Cited

U.S. PATENT DOCUMENTS 3,719,433 3/1973 Rabusin ..... 417/48
3,996,488 12/1976 Zucchinelli ..... 417/48
5,508,586 4/1996 Martelli et al. ..... 313/560

FOREIGN PATENT DOCUMENTS 58-154147 9/1983 Japan ..... 313/481

*Primary Examiner*—Charles G. Freay
*Assistant Examiner*—Cheryl J. Tyler
*Attorney, Agent, or Firm*—Robert J. Kraus

[57] ABSTRACT

A vacuum device has an envelope and a getter assembly mounted within the envelope. The getter assembly includes a reservoir for containing getter material and a deflector having a surface located opposite the getter material and is oriented to deflect the getter material in a predetermined direction within the vacuum device. The deflector surface has raised and/or depressed portions, such as ribs or undulations, in the direction of diffusion of the getter material. These portions reduce the accumulation of getter material on the deflector during getterfiring, resulting in a much reduced likelihood that getter material particles may break loose from the deflector. By preventing loose particles within the vacuum device, the possibility of a short-circuit in the vacuum device is reduced.

8 Claims, 2 Drawing Sheets

VACUUM DEVICE HAVING A GETTER DEVICE

BACKGROUND OF THE INVENTION

The invention relates to a vacuum device having a getter device with a reservoir for getter material and a means to direct diffusion of the getter material.

Such a vacuum device is known from U.S. Pat. No. 3,719,433.

In U.S. Pat. No. 3,719,433, a vacuum device, in particular a cathode ray tube, is described having a getter device with a deflector to deflect the getter metal vapour and thus direct the diffusion of the getter material. The getter device is used to direct the stream of getter metal vapour during getterfiring of the getter material.

The presence of loose particles in the vacuum device may negatively influence the behaviour of the vacuum device. In particular in those vacuum device where a means for generating electrons is present, loose particles jeopardize the functioning of said means.

OBJECTS AND SUMMARY OF THE INVENTION

It is an object of the invention to provide an improved vacuum device of the type described in the opening paragraph.

To this end, a vacuum device of the type described in the opening paragraph is characterized in that the means has a surface facing the getter material, which surface has raised and/or depressed portions.

In a getter device having an annular deflector above an annular holder with getter material, the raised portions are radially extending ribs.

During getterfiring of the getter material, the getter material accumulates on the deflector. The means, also called the deflector, is cooler than the getter material, but its temperature is still relatively high. The getter material may break loose from the deflector. Such loose particles, usually comprising a metal (Barium), may cause a short-circuit in other parts of the vacuum device. Such short-circuits have detrimental effects on the functioning of the vacuum device. The loose particles are also sources of electron emission, which is undesirable. The vacuum device of the invention comprises a deflector wherein the surface facing the getter material has raised and/or depressed portions. Such portions reduce the accumulation of getter material on the deflector, resulting in a much reduced likelihood that getter material particles break loose from the deflector and thereby resulting in an improved vacuum device, having especially an improved high-voltage behaviour.

These and other aspects of the invention will be apparent from and elucidated with reference to the embodiments described hereinafter.

BRIEF DESCRIPTION OF THE DRAWINGS

In the drawings.

The figures are not drawn to scale. In general, like reference numerals refer to like parts in the Figures.

DESCRIPTION OF THE PREFERRED EMBODIMENTS

Figure 1:
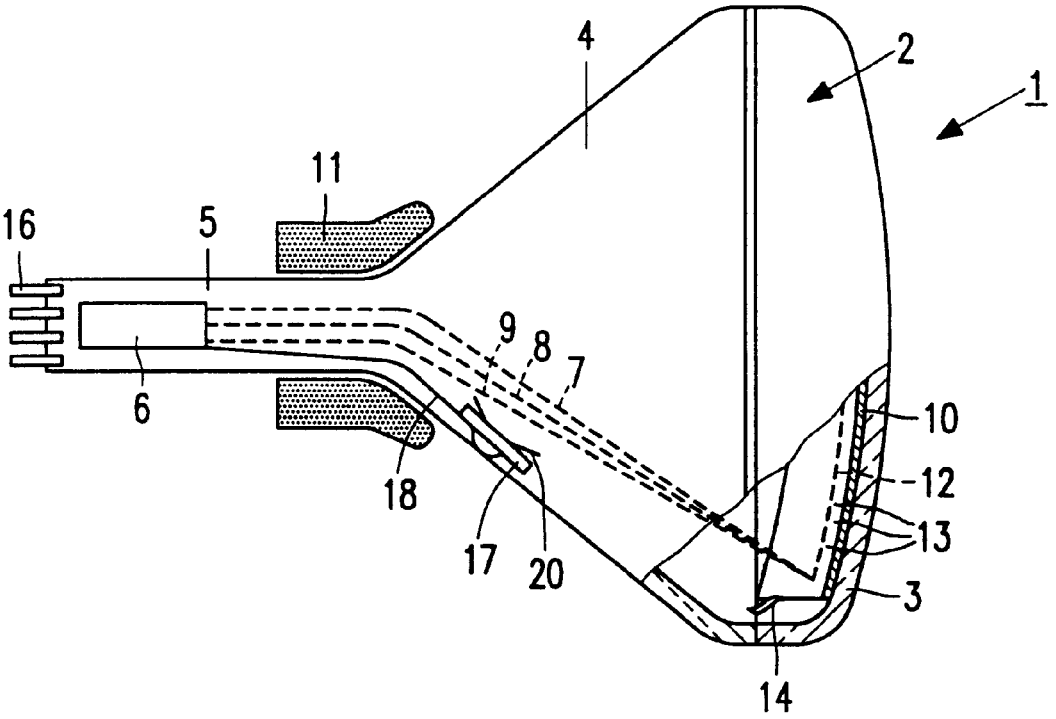
FIG. 1 shows a sectional view of a cathode ray tube.

FIG. 1 shows a cathode ray tube, in this example a colour cathode ray tube 1, which comprises an evacuated envelope 2 comprising a display window 3, a cone portion 4 and a neck 5. In said neck an electron gun 6 is provided for generating three electron beams 7, 8 an 9 which extend in one plane, the in-line plane, which in this example is the plane of drawing. A display screen 10 is provided on the inner surface of the display window 3. Said display screen 10 comprises a large number of phosphor elements luminescing in red, green and blue. On their way to the display screen, the electron beams are deflected across the display screen 10 by means of electromagnetic deflection unit 11 and pass through a colour selection electrode 12 which is arranged in front of the display window 3 and comprises a thin plate having a large number of apertures 13. The colour selection electrode (sometimes also called "shadow mask") is suspended in the display window by means of suspension elements. The three electron beams 7, 8 and 9 pass through the apertures 13 of the colour selection electrodes at a small angle with respect to each other and, consequently, each electron beam impinges on phosphor elements of only one colour. The cathode ray tube further comprises feedthroughs 16 through which, in operation, voltages are applied to electrodes of the electron gun. The cathode ray tube further comprises a getter device 17, which in this example, is attached to the electron gun 6 by a pole 18. During evacuation of the tube the getter device is activated for instance by RF-heating, causing the getter material to evaporate and the vacuum to be improved. To prevent the getter material from reaching parts such as the screen or the electron gun, where precipitation of the getter material can have detrimental effects, the getter device 16 is provided with a deflector 20.

Figure 2:
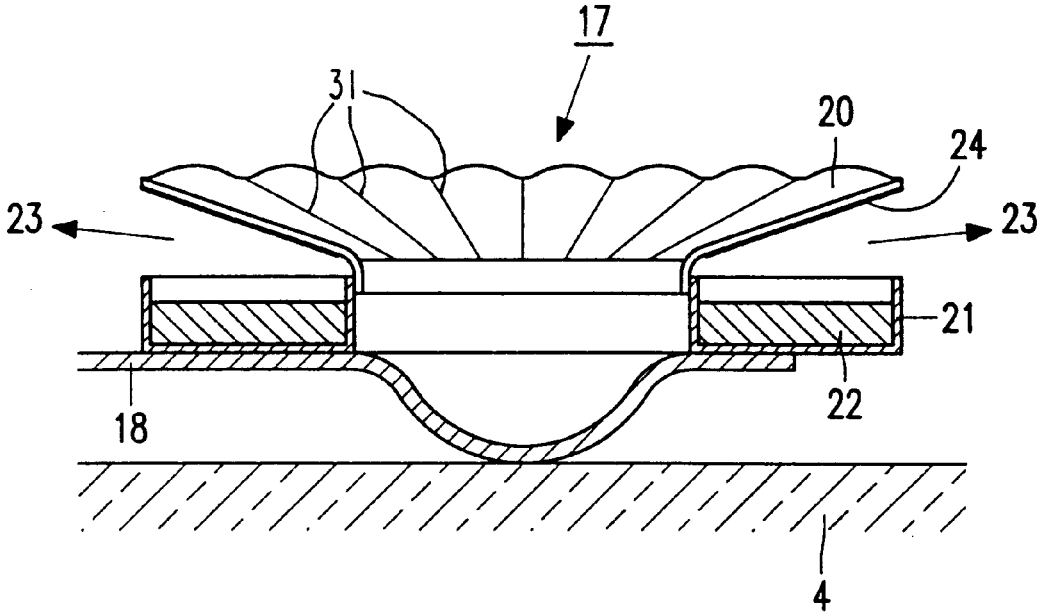
FIG. 2 shows a sectional view of a getter device.

FIG. 2 shows the getter device. In this example the getter device has a more or less annular shape, having an annular reservoir 21 of getter material 22. The deflector, which is annular in this example, is positioned above the reservoir. The getter material is made to evaporate in the radial directions indicated by the arrows 23. Some of the getter material, however, precipitates on the surface of the deflector. Such an accumulation shown in FIG. 2 by layer 24. Parts of the layer may come loose from the deflector. Such loose particles can have detrimental effects on the functioning of the cathode ray tube, especially in the electron gun where short-circuits may be caused or in the vicinity of the electron gun where relatively high electric fields are present which may cause the loose particles to emit electrons. It has been found within the framework of the invention that during getterfiring getter material precipitates on the deflector, spreads out over the deflector and accumulates in the form of relatively large and thick flakes. These flakes may become detached and hence cause the formation of loose particles. Providing raised and/or depressed portions on the deflector has a remarkable effect on the accumulation of the getter material. Accumulation is largely prevented, so that the risk that loose particles are formed is reduced, while the size of any loose particles formed is diminished. As a result, the negative effects of loose particles (such as short-circuiting parts of the electron gun, or obstructing the apertures in the shadow mask) are, for example, reduced substantially. The raised and/or depressed portions can be in the form, for example, of ribs, notches, protrusions, slits.

Ribs 31 such as shown in FIG. 2 (including undulating forms such as shown in FIG. 2) also strengthen the deflector. Preferably, the ribs extend in the direction of diffusion of the getter material, i.e. in this example in the radial direction. Such ribs do not restrict the outflow of getter material during getterfiring, i.e. use of the getter. Providing the deflector with depressed portions in which the thickness of the deflector is decreased relative to the rest of the deflector (e.g. slits or cuts) has the advantage that the strength of eddy currents in the deflector during getterfiring is reduced, which has a tempering effect on the temperature of the deflector.

Figure 3:
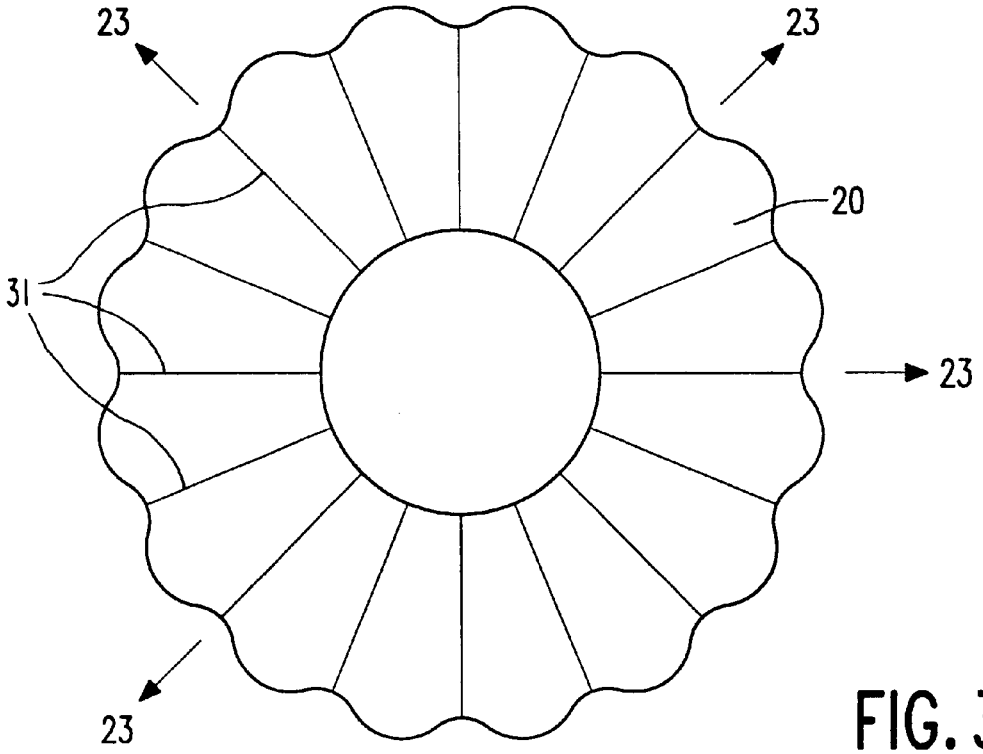
FIG. 3 shows a top view of a getter device of annular form.

FIG. 3 shows a top view of a getter device for a vacuum tube according to the invention. The deflector is provided with ribs 31 extending in the direction of diffusion of the getter material (indicated by an arrow). Therefore, the ribs extend radial in this case.

Figure 4:
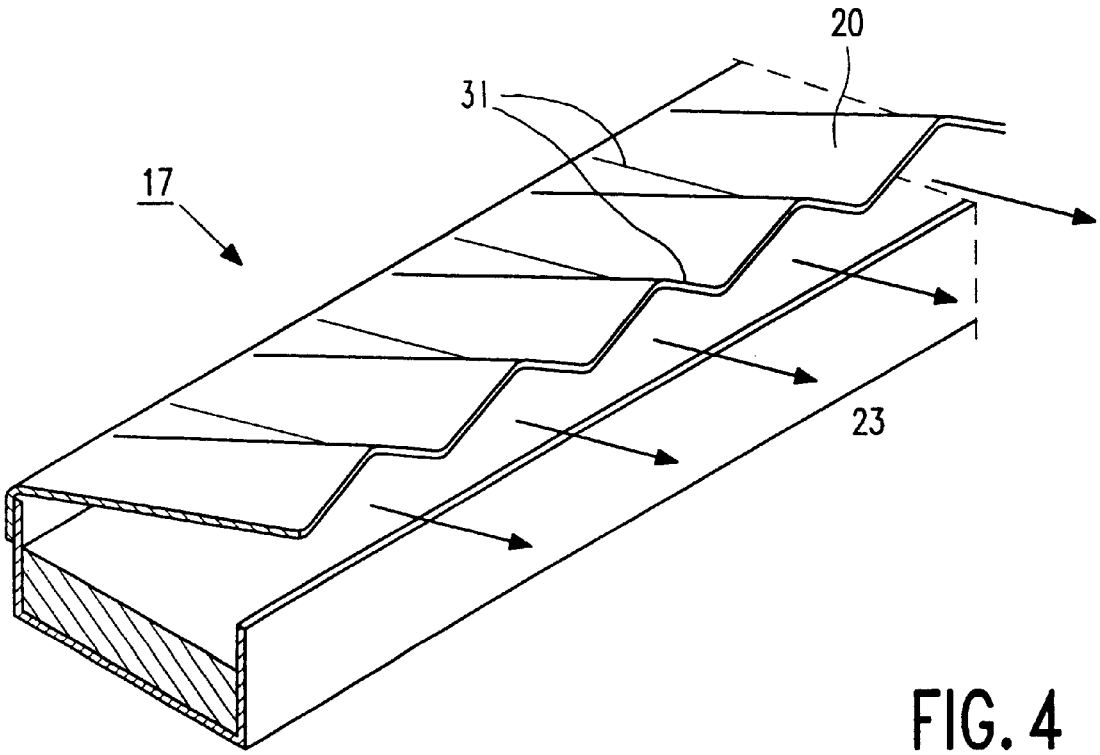
FIG. 4 shows a top view of a getter device of linear form.

FIG. 4 shows a top view of a getter device having a getter reservoir of linear form having a deflector of linear form. Such a getter device can be used, for instance, in thin type display devices such as plasma devices. The deflector comprises ribs 31 extending transversely to the length of the deflector.

The ribs in or on the deflector may be made, for instance, by undulating the surface of the deflector or by attaching ribs to a flat deflector or folding the surface of the deflector so that the surface is ribbed.

In Summary, the invention provides a vacuum device with a getter device.

The getter device comprises a deflector having a surface facing the getter material which surface has raised and/or depressed portions. These portions can be formed, e.g. by ribs or undulations, preferably in the direction of diffusion of the getter material.

We claim:

1. A vacuum device comprising an envelope and a getter mounted within the envelope, said getter comprising:

a. a reservoir for holding a getter material;

b. a deflector having a surface disposed opposite the getter material and oriented for deflecting said getter material in a predetermined direction in the vacuum device;

the surface having a non-flat shape to inhibit accumulation of the getter material on said surface.

2. A vacuum device as in claim 1 where the surface comprises raised portions.

3. A vacuum device as in claim 1 where the surface comprises depressed portions.

4. A vacuum device as in claim 1 where the surface comprises ribs.

5. A vacuum device as in claim 5 where the ribs extend approximately in the direction of diffusion of the getter material.

6. A vacuum device as in claim 1 where the surface comprises undulations.

7. A vacuum device as in claim 1 where the reservoir has an annular shape.

8. A vacuum device as in claim 1 where the reservoir has a rectangular shape.

* * * * *